US005325804A

United States Patent [19]

Schneider

[11] Patent Number: 5,325,804

[45] Date of Patent: Jul. 5, 1994

[54] FUEL-EFFICIENT WATERCRAFT WITH IMPROVED SPEED, STABILITY, AND SAFETY CHARACTERISTICS

[76] Inventor: Richard T. Schneider, 17 Alachua Highlands, Alachua, Fla. 32615

[21] Appl. No.: 2,302

[22] Filed: Jan. 8, 1993

[51] Int. Cl.[5] ..... B63B 1/12

[52] U.S. Cl. ..... 114/61; 114/125

[58] Field of Search ..... 114/283, 61, 333, 185

[56] References Cited

U.S. PATENT DOCUMENTS

| | | | |
|---|---|---|---|
| 1,399,236 | 12/1921 | Lantz | 114/333 |
| 2,949,791 | 8/1960 | Cahaneo et al. | 440/63 |
| 2,972,972 | 2/1961 | Allen | 114/333 |
| 3,541,987 | 11/1970 | Barkley | 114/61 |
| 3,604,382 | 9/1971 | Sorrenti | 114/61 |
| 3,626,881 | 12/1971 | Lovingham | 114/333 |
| 3,897,744 | 8/1975 | Lang | 114/61 |
| 3,901,177 | 8/1975 | Scott | 440/61 |
| 4,541,356 | 9/1985 | Jones et al. | 114/61 |
| 4,841,896 | 6/1989 | Fury | 114/312 |

FOREIGN PATENT DOCUMENTS

| | | | |
|---|---|---|---|
| 0244368 | 11/1987 | European Pat. Off. | 114/125 |
| 1568509 | 5/1980 | United Kingdom | 114/125 |

*Primary Examiner*—Sherman Basinger
*Attorney, Agent, or Firm*—Saliwanchik & Saliwanchik

[57] ABSTRACT

A watercraft mounted on submarine hulls is taught which is capable of moving faster than a displacement vessel of the same length, while consuming equal or less fuel than would such a displacement vessel. The watercraft also has improved safety and stability characteristics, including the capability of operation in a raft configuration as well as the capability of beaching or parking in shallow water such that wave action does not affect the cabin occupants.

17 Claims, 14 Drawing Sheets

FUEL-EFFICIENT WATERCRAFT WITH IMPROVED SPEED, STABILITY, AND SAFETY CHARACTERISTICS

BACKGROUND OF THE INVENTION

Two main objectives for transportation of personnel or cargo on water can be distinguished: economical transportation (heretofore slow) and fast transportation (heretofore not economically efficient). The types of watercraft in use may be summarized as (1) displacement vessels, (2) planing hulls, (3) hydrofoils, (4) submarines, (5) non-ships like hovercrafts or other airborne configurations. Usually, the above-listed vessels are mono-hulls, although in principle they all could be used in a twin-hull or multi-hull configuration.

The achievable speed of a displacement vessel is limited to a Froude number of 1.3 (sometimes also called Taylor coefficient), a number which is proportional to the square root of the waterline length of a vessel. The physical reason for this limitation is that the displacement vessel creates a disturbance with its bow, which turns—as does any disturbance in water—into a wave. If the displacement vessel tries to go faster than the so created wave, it would have to climb over this wave. Any attempt to do so requires addition of more power. However, as additional power is applied, most of the power contributes to increasing the amplitude of the created wave. The ship therefore tries to climb over an ever-increasing mountain of its own making. The harder it climbs, the higher the mountain grows. Therefore, a displacement vessel cannot go faster than the velocity of the surface wave it creates.

To overcome this barrier the hull design has to be changed. The planing hull is one such design which is capable of going faster than the surface wave that it creates. The planing hull is more akin to an airplane than to a ship; the difference is that the weight of a displacement vessel is supported by the buoyancy (static) forces, while the weight of a planing hull vessel is supported by the induced lift (dynamic) forces. The consequence is that these induced forces cause extraordinary power (fuel) consumption. The planing hull is therefore inherently not suitable for fuel efficient transportation. Similar arguments are true for hydrofoils and hovercrafts.

The submarine is not limited in speed by the surface wave of the water, as long as the submarine is at least 3 hull diameters below the surface. There are of course frictional and other resistance forces impeding the movement of a submarine, however such forces act also on any other watercraft. Non-military transportation of personnel or cargo by submarines was proposed as early as 1914 and cargo submarines were indeed used during that era, yet this mode of transportation did not gain wide acceptance. The reason for this failure can be labeled the "Volume Problem" for the purposes of the present discussion. If one were to transport bulk cargo having a specific gravity larger than unity, an argument could indeed be made for the feasibility of a cargo submarine. However for personnel transportation, where there must be sufficient space for the occupants to move around, the Volume Problem exists. This means the void space provided for moving about will result in buoyancy that needs to be compensated for by ballast. For a submarine, which needs to be capable of surfacing, this ballast is usually water. Once inside the ballast tanks, this water is dead weight and needs to be transported as, in effect, useless cargo. Transportation of weight in any vehicle causes fuel consumption. Consequently, a vehicle transporting personnel underwater will consume more fuel underwater than a displacement vessel on top of the water carrying the same payload, provided the speed required is less than the maximum hull speed of the surface vessel.

Consequently, it is tempting to combine the advantages of the surface vessel with the advantages of the submarine, the main goal being to avoid the hull speed limitation of the surface vessel. Such proposals have been made in the past. U.S. Pat. No. 3,897,744, issued to Thomas G. Lang, is one example. Lang discloses two elongated hulls that are totally submerged and that support the ship above the water line. Ballasting chambers are disclosed as a part of these hulls; therefore this design suffers from the Volume Problem. Additionally, it does not eliminate the hull speed limitation. The reason that this is true is that for large ships the connection between the underwater hulls and the cargo hull have to be able to carry a substantial load. Long teaches that the buoyancy increases as the connections are further submerged. In this respect they act by displacement of water. These voluminous connections are also necessary to avoid the "Stability Problem." Therefore, these connections will have a substantial volume, which creates a surface wave, and this introduces a hull speed limitation. Ironically, the hull speed limitation caused by the connections is worse than the surface vessel would have since the waterline length of the connections (which determines the hull speed) is shorter than the waterline length the surface ship would have, and consequently the hull speed of the connection is slower than the hull speed of the surface ship. Also, these connections add additional weight and cost compared to a displacement vessel. The problem pointed out here is called, for the purposes of the present description, the "Connection Problem." This problem is inherent to the concept of underwater supporting hulls and therefore not restricted to the above cited patent.

There is still another problem inherent to the concept of combining the advantages of the surface vessel with the advantages of the submarine—the fact that the center of gravity is located above the center of buoyancy, which is an unstable configuration. As soon as they are no longer exactly vertically aligned, the center of gravity will move downward while the center of buoyancy will move upwards. The consequences will be that one of the submarine hulls will move to the surface, causing the surface platform to list. As the surface platform lists, the vessel's center of gravity moves from an original position which was between the two hulls toward a position above the submerged hull. Once the center of gravity passes the vertical above the submerged hull, buoyancy of the submerged hull will cause it to move upwards while the vessel's center of gravity will continue to move downward, thereby capsizing the vessel. For the purposes of the present description this problem is called the "Stability Problem."

OBJECTIVE OF THE INVENTION

It is the objective of this invention to overcome the hull speed limitation of a surface vessel by suspending it on two submerged hulls, which have sufficient buoyancy to support the surface vessel above the water line, in such a way that the "Volume Problem," the "Connection Problem," and the "Stability Problem" are overcome. The subject invention does this; it is a vessel which is considerably faster (at least by a factor of 2) than a displacement hull of the same waterline length.

BRIEF SUMMARY OF THE INVENTION

The present invention is a watercraft comprising a watertight cabin which is optimally between 10' and 40' in length, but may be longer, and of sufficient height to afford the occupants some space for moving around. The side walls of this cabin are slanted to avoid vertical surfaces. In a preferred embodiment, the cabin is supported on two submarine hulls by tubular stanchions in a way that keeps the cabin normally above the water surface. Considering the size of the cabin, the stanchions required are of small diameter (less than 4"), which will ripple the water but cause no wake. Therefore a "Connection Problem" does not exist.

The submarine hulls are equipped with flow tubes. These tubes are located inside the submarine hulls and are open at the bow and stern of these hulls, so that water can flow through the tubes when the watercraft is moving. If surfacing of the submarine hulls is required, valves located at the intake and exhaust of these tubes are closed and any water trapped therebetween is removed by air pressure or pumps, which are means well known in the art. Thus, excess buoyancy is created of sufficient magnitude to allow both submarine hulls to float on the surface. The water that was removed from the flow tubes was not carried with the craft while under way. It remained stationary as the boat passed through it, thus not requiring additional fuel consumption for serving as ballast. Nevertheless, it did serve the function of ballast. For example, any forces causing a vertical movement of the craft will have to overcome the inertial forces necessary to accelerate the water that happens to be in the flow tube at the instant the vertical forces are applied. While this is especially true for vertical movements (rolling), it also applies to pitching motions, as long as the vertical velocity vector of the pitching movement is large compared to the horizontal velocity vector of the water velocity inside the flow tube. Based on this, the net buoyancy (total buoyancy of the submarine hulls with flow tubes full of air minus this buoyancy with flow tubes full of water) can be configured to make the total watercraft nearly neutrally buoyant. There will be a small excess buoyancy required to compensate for varying payloads. Considering the above statements one can see that the "Volume Problem" is avoided.

The "Stability Problem" is caused by a labile equilibrium between center of buoyancy and center of gravity. To overcome this problem, the submarine hulls are spaced apart by a distance greater than the width of the cabin. The cabin is watertight and will not sink. Therefore, should one hull rise to the surface while the other descends, the edge of the cabin will ultimately contact the water, providing additional buoyancy. A stable (default) configuration is achieved at this point. To remedy the default situation, the valves on both tubes could be opened, flooding both tubes and thereby causing the craft to reachieve balance. Alternatively, one could close the valves on the flow tubes of both submarine hulls and remove (blow) any water contained therein. The blown flow tube will increase the total buoyancy of the submerged hull sufficiently for it to support the total weight of the cabin. This requirement sets the design criteria for the preferred size of the flow tubes. However, if this requirement should turn out to be inconvenient for other reasons, it can be relaxed to a standard such that the buoyancy of each hull, having a blown flow tube, can support more the half of the weight of the cabin. In an embodiment of this latter type, the flow tube of the submarine hull on the surface needs to be kept open. Under these conditions, blowing of the submerged hull should be terminated as soon the craft moves into a horizontally correct position, at which point the valves of this flow tube should be opened immediately.

In addition, the outboard side of each hull is equipped with a stabilization control surface, the normal of which is horizontal or up to about 45 degrees in respect to the horizontal. An initial deviation from the equilibrium causes only small side forces and therefore the acceleration towards the surface is also initially small, allowing sufficient time to correct the problem with the control surfaces. Each control surface has a bow end and a stern end and is swingably attached at its bow end to the hull, for example, by a hinge. Normally this control surface lays flat against the wall of the submarine hull. However, when activated, the stern end will move outward, away from the side of the hull. In effect, this control surface constitutes an angle of attack in respect to the forward movement of the craft, thus providing a "lift" in a horizontal direction, opposing the direction the hull in question would tend to take in order to get to the surface. Under most circumstances, only one of the control surfaces is activated at any given time.

Under normal operating conditions, these control surfaces are also used for steering. If a right turn is desired the control surface on the outboard side of the right submarine hull is deployed. This slows the right submarine hull down, effecting a right turn as well as a tilt to the right, as is expected of a turning boat.

While steering is normally accomplished by activation of the above described stabilization control surfaces, it can also be done by or in connection with thrust control if an engine is installed at each submarine hull's stern. Control of pitching motion can be accomplished by horizontally disposed vertical control fins at each submarine hull stern. These vertical control fins can be moved in unison providing pitch control, and in opposite directions providing roll control. The latter has to be coordinated with the effects of the stabilization control surfaces, if such are used at the same time as the vertical control fins. In short, all controls must be used in a coordinated fashion.

As disclosed above, the two submarine hulls are required to have a slightly larger net buoyancy than that required to make the total watercraft neutrally buoyant. This allows for variation in payload from trip to trip. Therefore, the net buoyancy should be sufficient to accommodate the maximum design load plus a safety margin. This is accomplished by small individual ballast tanks, or "trim tanks," placed at the stern and bow sections of the submarine hulls. So placed, they can also be used for trimming purposes.

It is also possible to fill hull cavities with water, which will negatively affect the net buoyancy. Consequently, the craft will sink until the bottom of the cabin touches the water surface. At this position, more buoyancy is added to the system, since the cabin is watertight and its bottom is designed to accommodate the hydraulic pressure it will experience as it contacts the water's surface. The watercraft is now converted to a raft, the most stable configuration of any watercraft. The capability for such a transformation is desirable, since the craft should be able to survive any weather experienced. In this configuration the craft is, in effect, a ballasted displacement vessel, and, therefore, its capability of generating forward speed is greatly reduced. However, in extreme weather conditions survival is more important than forward speed. The engines would only be used for maintaining a heave-to condition. Since the cabin is watertight, extreme waves may run over the craft occasionally without doing any harm.

In anticipation of the possibility of wave run-over, vertical surfaces are avoided on the cabin. Waves only do damage if they can deposit some of their kinetic energy on an object in their way. If the object is streamlined in respect to the approaching wave, such a delivery of kinetic energy is minimal. A conventional surface ship having lost its propulsion capability will tend to turn broadside to the approaching waves, and so offer many vertical surfaces or an irregular, non-streamlined superstructure for dissipation of the wave's kinetic energy, and thereby suffer damage. In case the watercraft of the present invention should lose its propulsion means, the craft will not broach, although it may lay broadside to the approaching waves, since few or no non-streamlined surfaces are offered to the waves.

The fact that the cabin is watertight in its entirety also allows one to imbed a metal honeycomb structure or a metal mesh into the cabin wall. In this way a Faraday cage is created, which provides protection of the cabin occupants against lightning strikes.

In summary, the present invention teaches a watercraft capable of moving faster than a displacement vessel of the same length, while consuming equal or less fuel than would such a displacement vessel. The watercraft can be operated with the submarine hulls submerged to regular operation depth, a configuration in which the cabin does not touch the water surface; or it can be operated with the submarine hulls having a negative buoyancy, thereby converting the watercraft of the present invention into a raft affording survival in extreme sea conditions; or it can be operated with the submarine hulls providing sufficient buoyancy for said submarine hulls to break the surface of the water. This mode of operation affords access to shallow water or marinas. In the negative buoyancy configuration the submarine hulls can be set on the bottom of the body of water, provided that it is shallow enough so that the cabin still does not touch the water surface. In this condition the craft is "parked," meaning the occupants are not subject to any movement of the craft and the craft does not need to be anchored.

DETAILED DESCRIPTION OF THE DISCLOSURE

Figure 1:
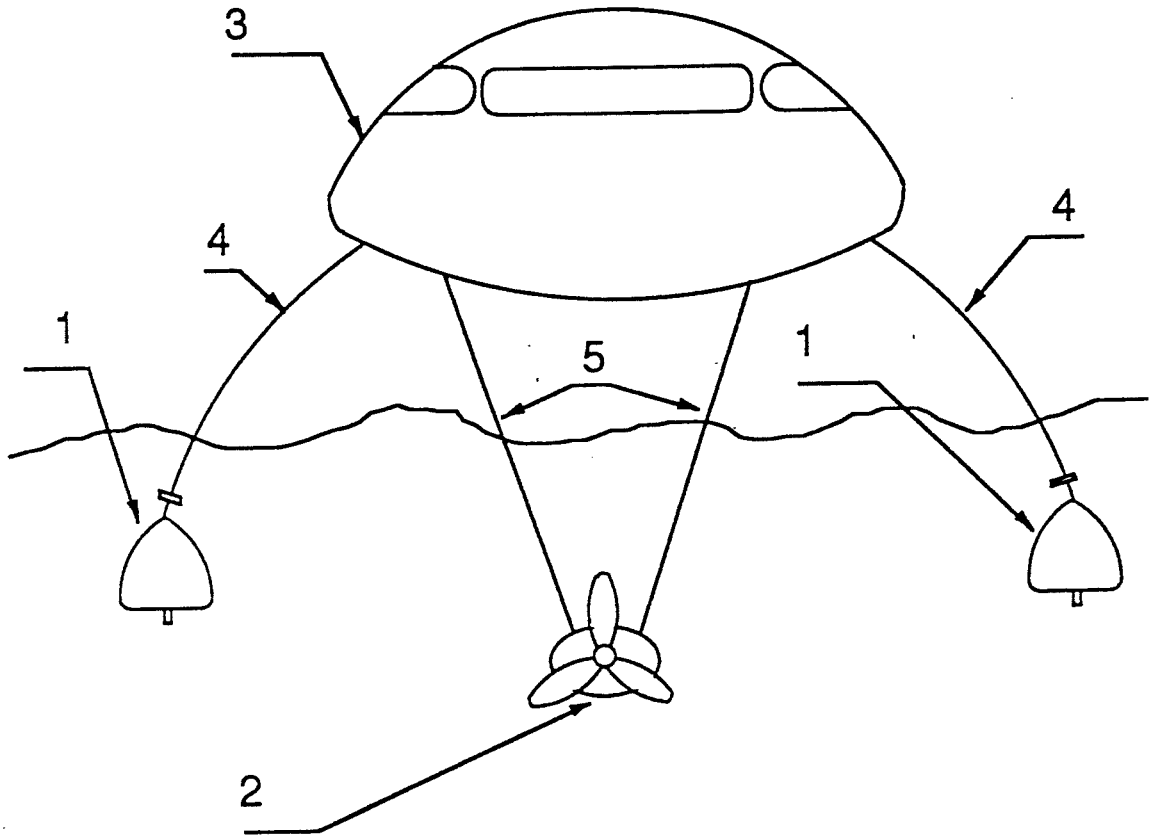
FIG. 1 is the frontal view of a preferred embodiment of the fuel-efficient watercraft.
Figure 2:
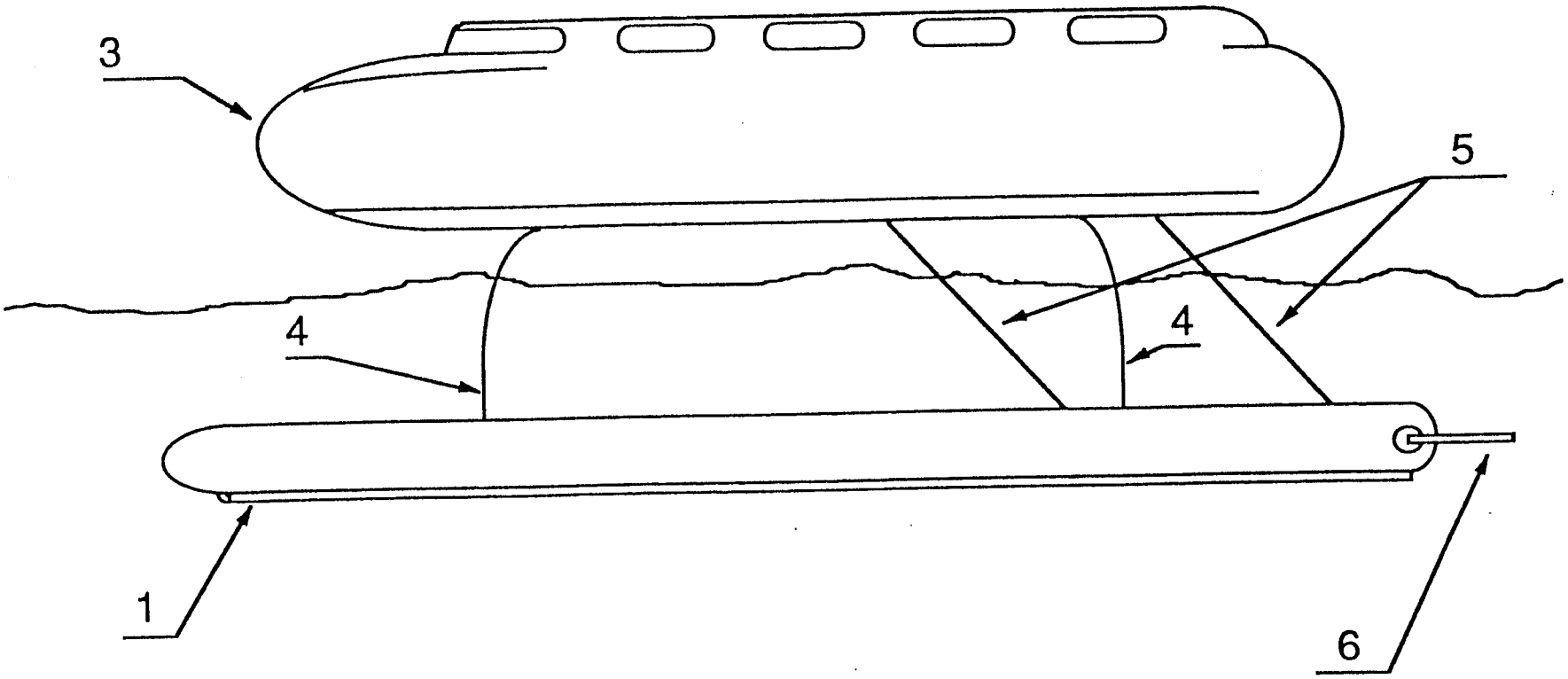
FIG. 2 is a side view of the watercraft depicted in FIG. 1.

As depicted in FIG. 1, a preferred embodiment of the invention comprises two submarine hulls (1), an engine pod (2), and a cabin (3) supported on the submerged hulls (1) by stanchions (4). In a preferred embodiment, the stanchions are tubular, providing strength and enabling them to function as conduits for necessary mechanical, electrical, hydraulic, or pneumatic lines between the hulls (1) and cabin (3). Engine pod (2) is suspended from cabin (3) by swing bars (5). FIG. 2 shows the side view of this embodiment. As can be seen also in FIG. 2 the engine pod (2) is held by two parallel swing bars (5). In alternative embodiments, the engine pod can be held by one or more swing bars. In normal operating condition, the cabin (3) does not touch the surface of the water, nevertheless it is of a watertight design and of sufficient strength to accept the hydraulic pressure caused by the weight of the submarine hulls (1), if they are flooded. Also shown in FIG. 2 are the horizontally disposed vertical control fins (6) that allow control of pitching and rolling movements of the water craft.

Figure 3:
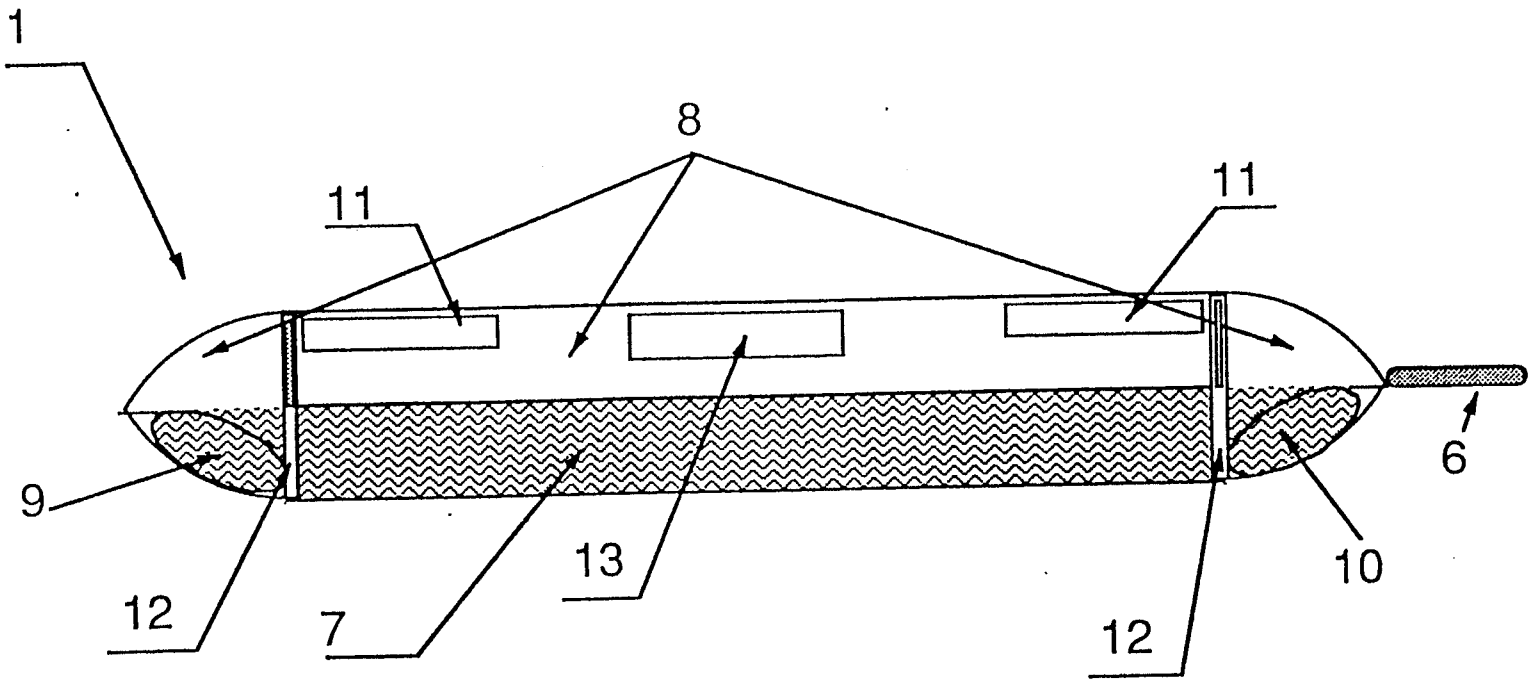
FIG. 3 is a side view of a longitudinal cross-section through one of the submarine hulls, showing the flow tube, the ballast tanks and the void space for creation of negative buoyancy.

FIG. 3 shows a longitudinal cross-section through one of the submarine hulls (1). Two major components are the flow tube (7) and the void space (8). As the watercraft moves forward, water enters bow-end opening (9), flows through flow tube (7), and exits stern-end opening (10). Also, small trim tanks (11) are located in the bow and stern section of the submarine hull (1), with a fuel tank (13) centrally disposed therebetween. In normal operation condition, as depicted in FIG. 1, the submarine hulls (1) are submerged sufficiently to avoid creating a noticeable bow wave. Such a condition is achieved by setting the valves (12) of the flow tubes (7) to an open position and the trim tanks (11) trimmed and adjusted so that the resulting buoyancy of both hulls combined is sufficient to support the weight of the cabin (3). The void space (8) can also be flooded; however this is only done when conversion to raft configuration is desired.

Figure 4:
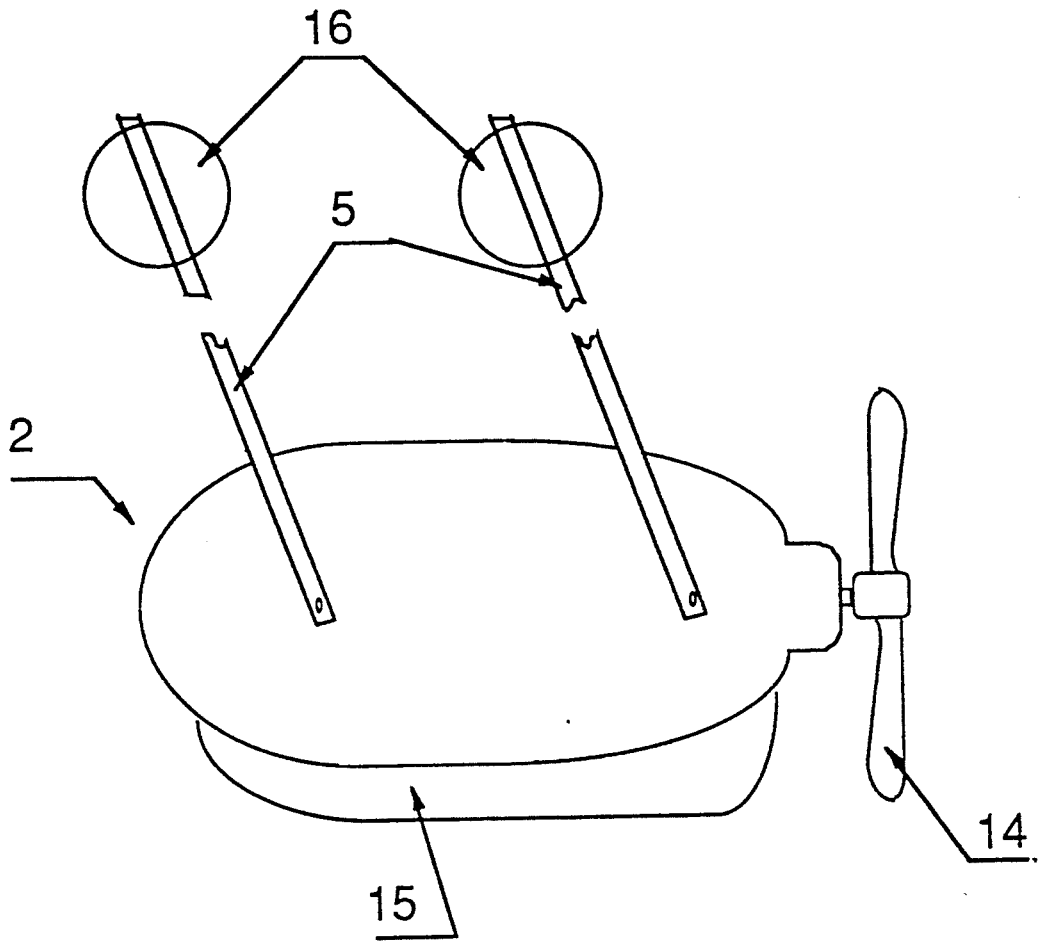
FIG. 4 shows the engine pod of the preferred embodiment depicted in FIGS. 1 and 2, and its suspension from the cabin.

FIG. 4 shows the engine pod (2). It can be raised and lowered on parallel swing bars (5). The propeller (14) is protected from grounding by a grounding bar (15). When the grounding bar (15) contacts the bottom, or a submerged obstacle, engine pod (2) is displaced backwards and upwards by motion of the swing bars (5), thereby allowing the pod to pass over the obstacle. Once the first contact occurs and engine pod (2) is displaced, a rachet mechanism (16) prevents the pod from returning into its original position. This ratchet mechanism (16) can be released by the operator once it is determined that no further danger of grounding exists. The engine pod (2) can also be swung back intentionally by the operator to avoid known obstacles or to gain access to the engine for servicing.

Control of rolling and pitching in normal operating condition is achieved by a combination of effects. Rolling is considerably damped by the water present in the open flow tubes (7). For rolling to occur, one of the submarine hulls (1) would have to be accelerated in a vertical direction. The water present in the flow tube (7) at any instant would have to be accelerated upwards as well. Since the weight of water inside the open flow tube (7) at any given time is substantial, the force required to vertically accelerate a hull is substantial, and rolling is thereby impeded. Advantageously, the watercraft of the subject invention gains this benefit without having to pay for this ballasting effect by carrying the weight of the water with the craft, and thereby is much more fuel efficient than a traditionally ballasted craft. Pitching is also damped, albeit to a lesser extent, for the same reasons. For the craft to pitch, the front part of the submarine hull would have to be accelerated upward and the back part accelerated downward (or vice versa). Being submerged, such an upwards movement could only be initiated by an upwards water current. Such currents, of course, do exist, but when encountered it is not reasonable to expect a sufficient downward current will be working on the other end of the hull to provide a force pair to turn the hull into a pitching movement.

Figure 5:
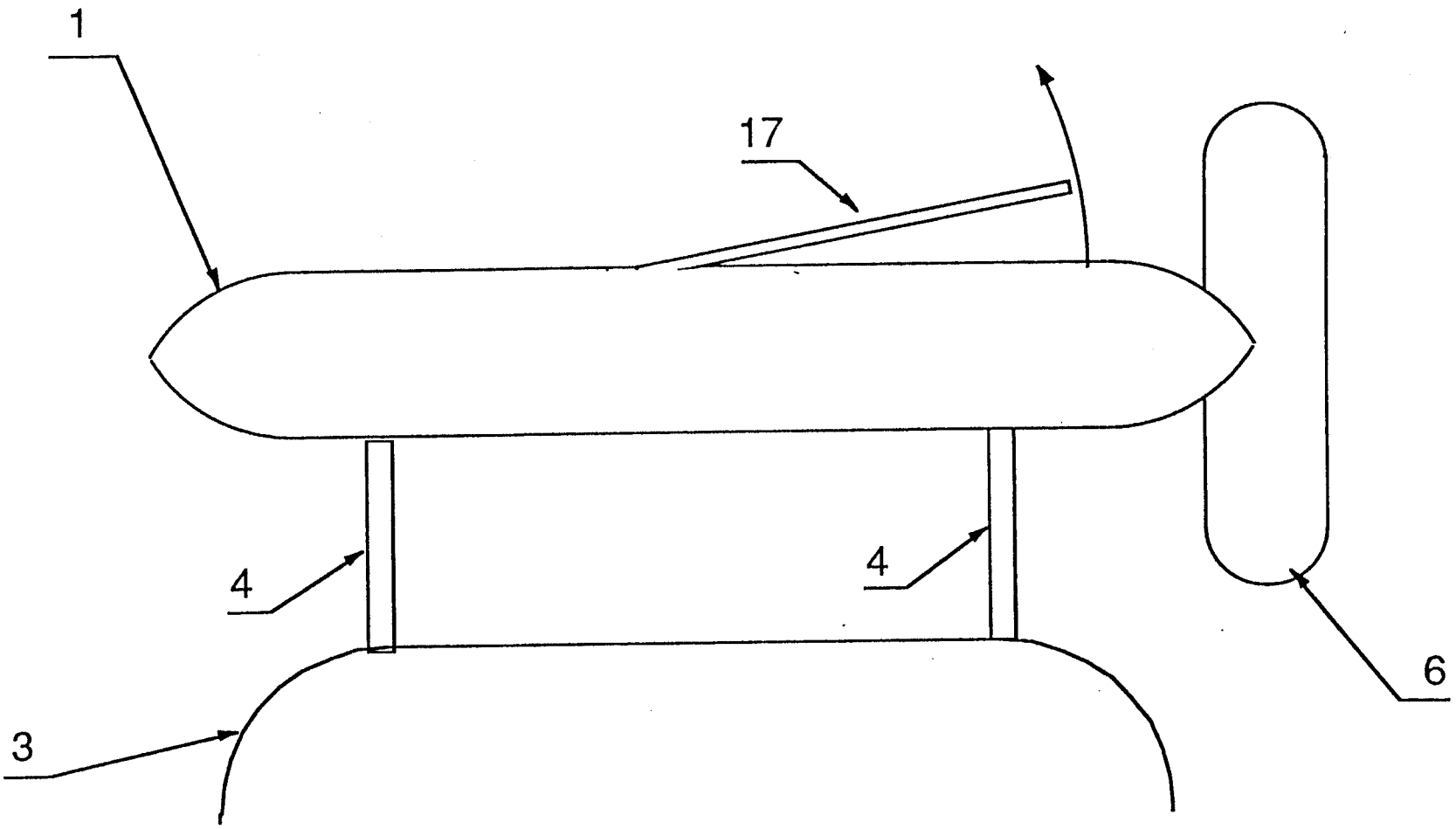
FIG. 5 is a top view of one of the submarine hulls, depicting vertical control fins and the stabilization control surface which serve as means for steering and stability control.

Another roll control is achieved by activating a stabilization control surface (17), which is shown in FIG. 5 and has been described above, thereby causing a sideways/downward pressure on the hull that is attempting to rise. Still another roll control is affected by opposite motion of the vertical control fins (6) mounted at the stern of the submarine hulls (1).

Figure 6:
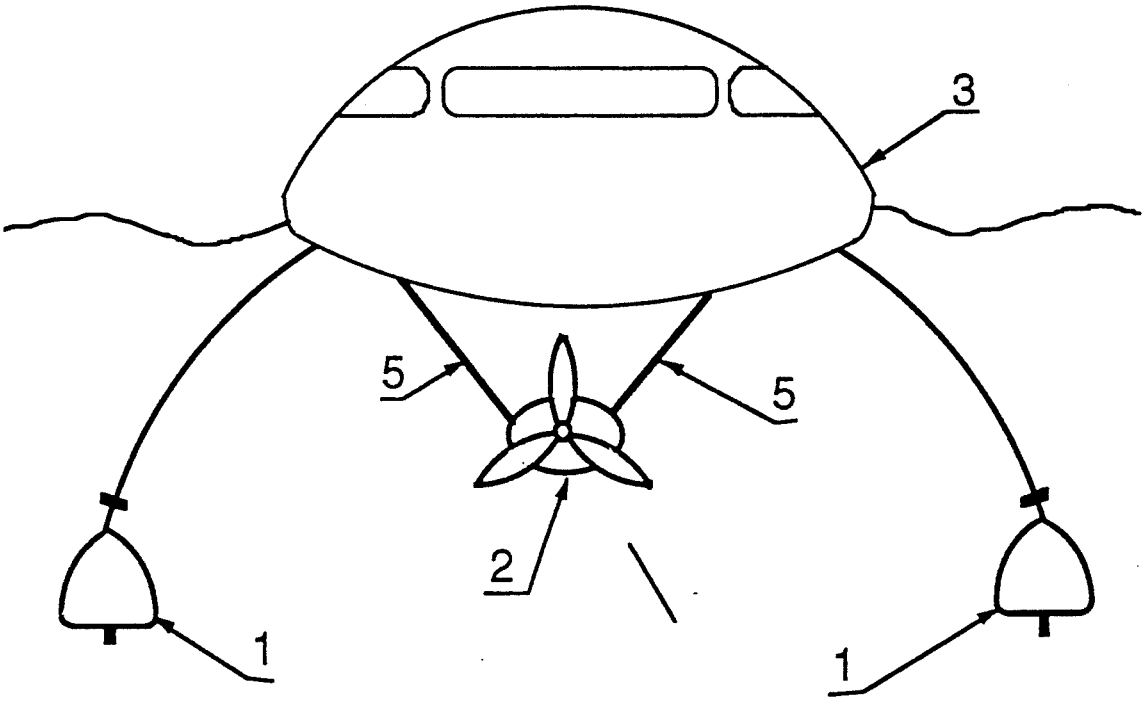
FIG. 6 is a frontal view of the preferred embodiment shown in FIGS. 1 and 2 when converted to raft configuration.

In extreme sea states the operator of the watercraft may decide to heave-to in order to wait out the storm, employing only minimal engine power, sufficient to hold the craft in an attitude oblique to the waves. Since at very low speeds dynamic controls designed to overcome the stability problem become ineffective, the watercraft needs to be converted to a more stable configuration. The most stable configuration amongst all waterborne vehicles is the raft. The fuel-efficient watercraft can be converted into a raft configuration, as depicted in FIG. 6, by flooding the submarine hulls completely. This is accomplished by having the flow tube (7) in an open configuration and the void space (8) flooded. In this case, owing to the structure comprising materials of a specific gravity larger than unity, the submarine hulls (1) now display a negative buoyancy, and the watercraft will sink until the bottom of the cabin (3) provides enough buoyancy to achieve normal floatation. Since vertical surfaces on the cabin (3) are avoided by the design, and since the height of the cabin (3) is restricted to no more than about 7', the watercraft displays now the characteristics of a raft. It will float on the surface of the water and conform to the waves rather than being assaulted by them.

In a preferred embodiment, the watercraft comprises a mast that is pivotally affixed to the top surface of the cabin such that it may be raised, or lowered as desired by means well known in the art. In its lowered configuration, the mast is secured against the surface of the cabin. In its raised configuration, the mast is secured perpendicular to the top surface of the cabin and allows the watercraft to be propelled by the wind, under sail, when engine power is unavailable or undesirable. In a particularly preferred embodiment, the mast is hollow and can function as an air vent, providing a conduit for fresh air supply into the watertight cabin, for example, when the craft is in heavy seas and in the raft configuration.

Additionally, a preferred embodiment of the craft also comprises at least one viewing port, disposed in the bottom portion of the cabin such that, when the craft is in the raft configuration, the viewing port is at least partially submerged and provides the occupants with an underwater view similar to the action of a glass-bottomed boat. Preferably, the view is in the direction of the bow end of the submarine hulls, so that the viewing port can aid in navigation and avoidance of obstacles, but the view is not necessarily limited to that direction. Further, a plurality of viewing ports may be provided that enable viewing in a number of directions.

Figure 7:
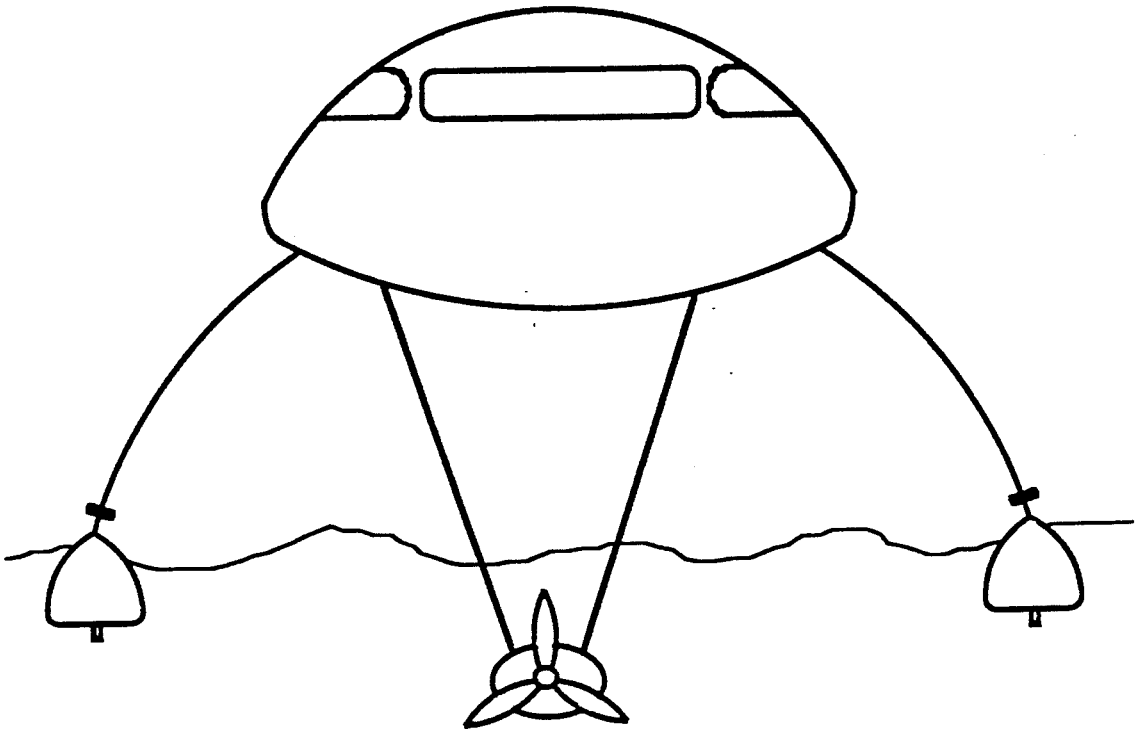
FIG. 7 shows the same embodiment as FIG. 6 when converted to surface configuration.

Another mode of operation for the fuel-efficient watercraft is the surface mode. To achieve this mode, the valves (12) on both flow tubes (7) are closed and the water in these tubes is removed by pumps or air pressure. The submarine hulls (1) will so rise to the surface as depicted in FIG. 7. Such a configuration is stable and can be used to venture in shallow water or for docking in marinas or harbors. For shallow water operation, the engine pod (2) can be raised and the propeller can so be operated partially out of the water. Alternatively, the engine pod can be raised even further to be completely out of the water, and in this case the craft can be propelled by a water jet that can be incorporated into the lower part of each of the submarine hulls. Such an operation allows beaching of the craft. In a beached condition the engine pod becomes easily accessible and can be serviced. Another application of the surface mode is emergency beaching. Such a maneuver may be necessary if the engine is for some reason inoperable, the watercraft is in heavy weather close to a sandy beach, and it is obvious that the wind will eventually push the craft to shore. Rather than waiting until the craft is pushed sideways onto the beach or runs aground on an off-beach sandbar, one could initiate an emergency beaching procedure. For this purpose, the craft is put in surface operation mode and a drogue (sea anchor) is deployed from the stern. In heavy weather there will be sufficient wind to push the boat on shore. The drogue will see to it that the craft is lined up roughly perpendicular to the beach. Since the craft is in surface mode it will ride in on one of the major waves and hit the sand once the wave shallows out. At this point, the submarine hulls need to be flooded completely so the craft is "parked" and cannot bounce up and down as following waves come in. It is now safe for the crew to leave the boat in the time span between incoming waves. There may be additional waves large enough to reach the bottom of the cabin and therefore be able to lift the craft and pound it on the sand. Since the crew is now safe on the beach, they could run a line to a tree or a rock, or deploy an anchor on shore and, with the aid of a winch provided with the craft, pull the craft farther on shore whenever it becomes waterborne again.

Figure 8:
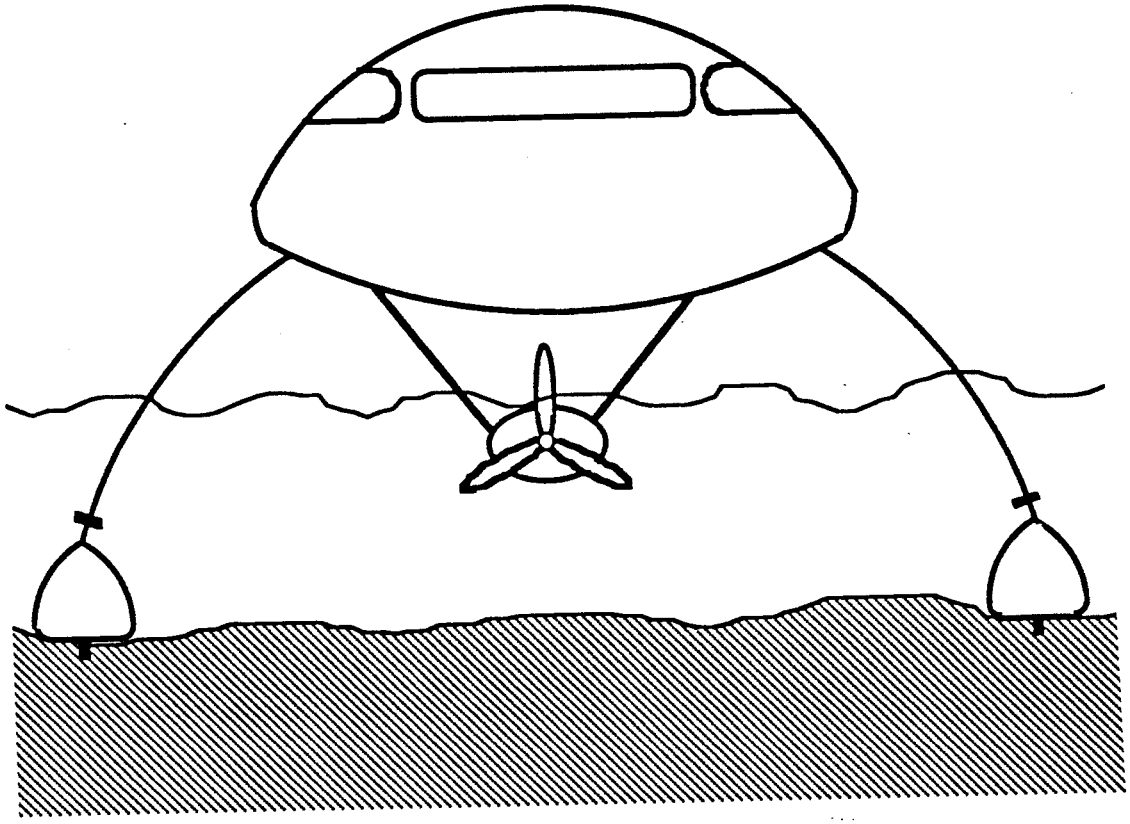
FIG. 8 shows the preferred embodiment in a parked configuration.

Operating in the surface mode, it is possible to enter shallow waters having a depth of between one and two diameters of a submarine hull and then flood the submarine hulls completely. The watercraft will sink until the submarine hulls touch bottom; however, the cabin will still be above the water surface. In such a configuration, which is depicted in FIG. 8, the craft is "parked." This means it will not move with the waves and need not be anchored. This configuration will allow the occupants to sleep without being subjected to wave motion.

Figure 9:
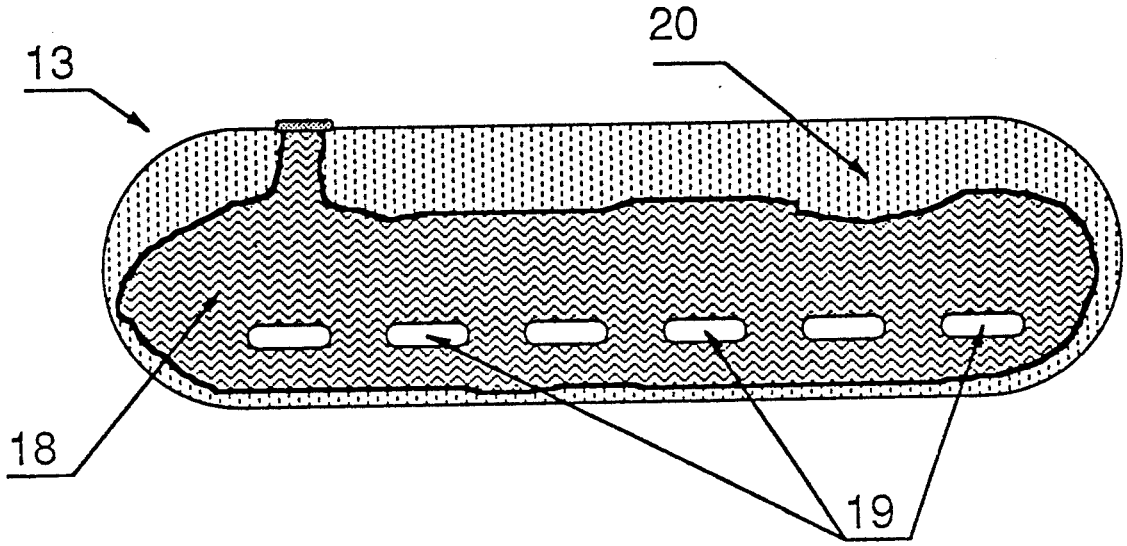
FIG. 9 shows a cross-section through the constant-weight fuel compartment.

While in normal operation, the craft needs to be trimmed using the trim tanks (11) to assure that it is in correct horizontal position. However, under ordinary circumstances, the fuel tanks (13) will tend to reduce their weight continuously as fuel is consumed. Trim could be maintained by proper fuel management, yet the buoyancy would need to be corrected by increasing the water content in the ballast tanks at the same rate as the fuel is consumed. This may force the designer to specify a larger ballast tank than is desirable. Therefore, as depicted in FIG. 9, the subject invention includes a self-compensating fuel tank (13). In this embodiment, the fuel is contained in a rubber fuel bladder (18). The fuel tank (13) has a plurality of slots (19) so that the sea water can fill in the void (20) created between the external surface of fuel bladder (18) and the internal surface of fuel tank (13) as fuel is used, at the same rate as the fuel disappears out of the bladder. Accordingly, the buoyancy is only changed by the difference of the specific gravities between fuel and water. When desired, for example, on extended voyages, additional self-compensating fuel tanks could be secured to the inboard sides of hulls (1) without creating volume, stability, or connection problems.

Figure 10:
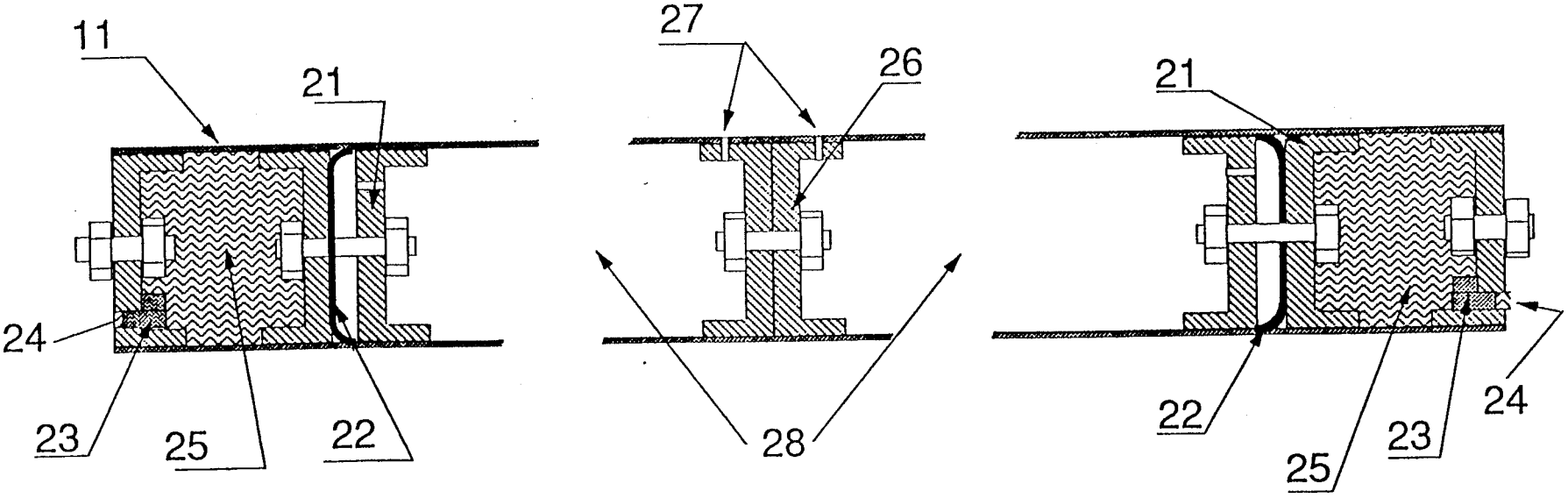
FIG. 10 shows the arrangement for avoiding slosh movement of water in a partially filled trim tank.

The trim tanks (11) are used to fine-tune the buoyancy according to the payload on board. Consequently, it will be necessary to fill the trim tanks in some instances only partially. Intake and evacuation of water is by way of water ports (24). Such a partially-filled tank may be subject to sloshing, which would introduce additional pitching or rolling motion. It is known in the art to combat this with slosh plates, which are perforated bulkheads inside the trim tank. For fine-tuning of the buoyancy, this is not satisfactory. Therefore, in FIG. 10, an improved means for stabilizing the content of a partially-filled trim tank (11) is shown. A central dividing wall (26) is located at the exact center of the tank. Air can be introduced on either side of this wall through the air ports (27). A piston (21) equipped with a gland (22) is disposed on each side of central dividing wall (26) such that when compressed air is forced through air port (27), piston (21) is actuated and forced towards its end of the trim tank (11), leaving behind a void space within trim tank (11) between piston (21) and central dividing wall (26), which is filled with compressed air. In this way, piston (21) operates to push the contents of the tank toward the distal end of the tank. Gland (22) ensures an effective seal around piston (21). A valve (23) may be located at the water port (24) to control the influx and exhaust of the sea water. By actuation of the piston (21), the sea water is forced into a minimum volume in containment areas (25) at the extreme ends of the tank, and therefore cannot slosh around. This occurs regardless of the amount of water in the tank. By applying different air pressures on each side of the central dividing wall (26), the void spaces (28) can be of different volumes. In this way, a trimming action, as well as a buoyancy control action, is achieved.

In one alternative embodiment, if self-compensating fuel tanks (13), are not used, the same means just described to prevent sloshing in trim tanks (11) can be employed to prevent sloshing within fuel tanks, as will be readily apparent to those skilled in the art in view of these teachings.

Figure 11:
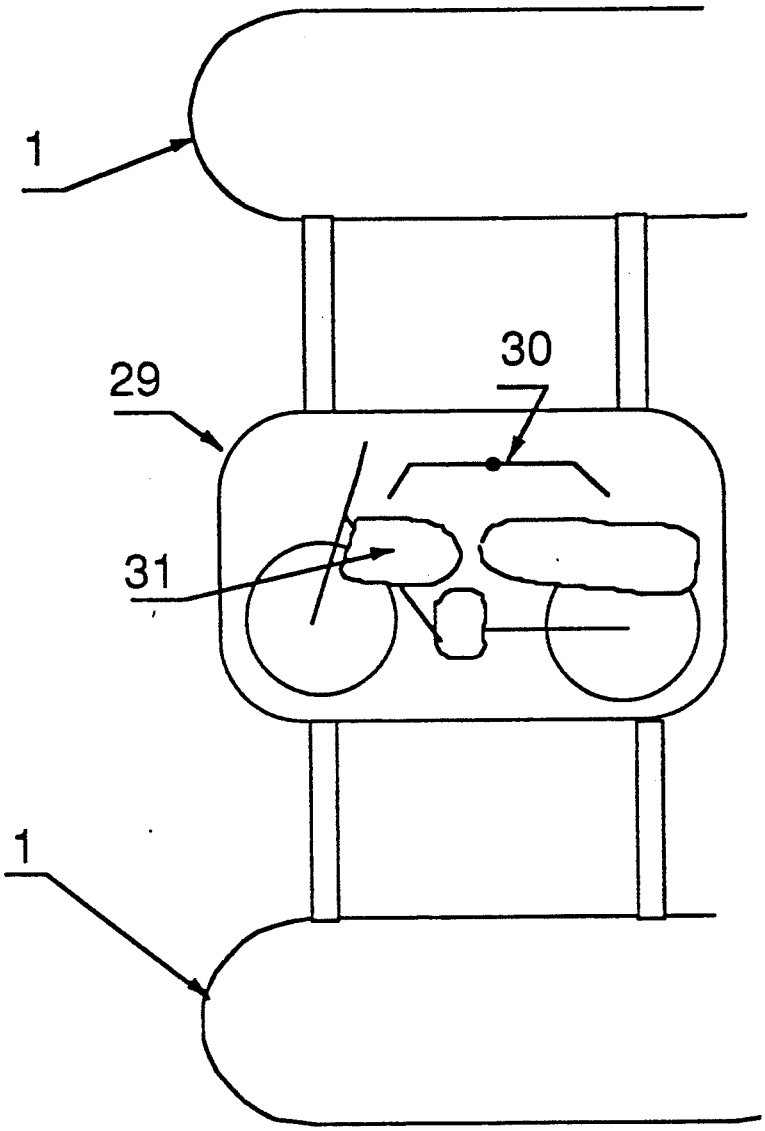
FIG. 11 shows a cargo container for use with the preferred embodiment, which container is capable of transporting a motorcycle as cargo.

FIG. 11 depicts a streamlined storage box (29) capable of storing a motorcycle. People who travel with a boat often need transportation when in harbors. For that reason, it would be convenient to carry one's own transportation on board. However, to carry, load, and unload a motorcycle on a 30′ motorboat is extremely difficult. The box depicted in FIG. 11, however, overcomes this difficulty. If the handle bar (30) of the motorcycle (31) is removed and separately stowed, the thickness of the box can be held to a minimum. In a preferred embodiment, the box is watertight and streamlined and is mounted in the space between the submarine hulls. The box can be floated to or removed from its location with ease, when the boat is bleached. If the craft is in surface mode in a harbor, the box is close to the surface and can still be released and floated to a location where it can be pulled to land (e.g., a boat ramp). Larger embodiments of the subject invention are capable of transporting a motorcycle or small car in a compartment at the stern of the cabin. To load or unload a vehicle, the watercraft is maneuvered close to a boat ramp or dock and parked with the craft's stern closest to the ramp or dock. The stern of the craft is opened and a loading ramp deployed to the boat ramp or dock, thereby providing ingress and egress to a compartment on the craft of sufficient height and width to accommodate the vehicle.

Figure 12:
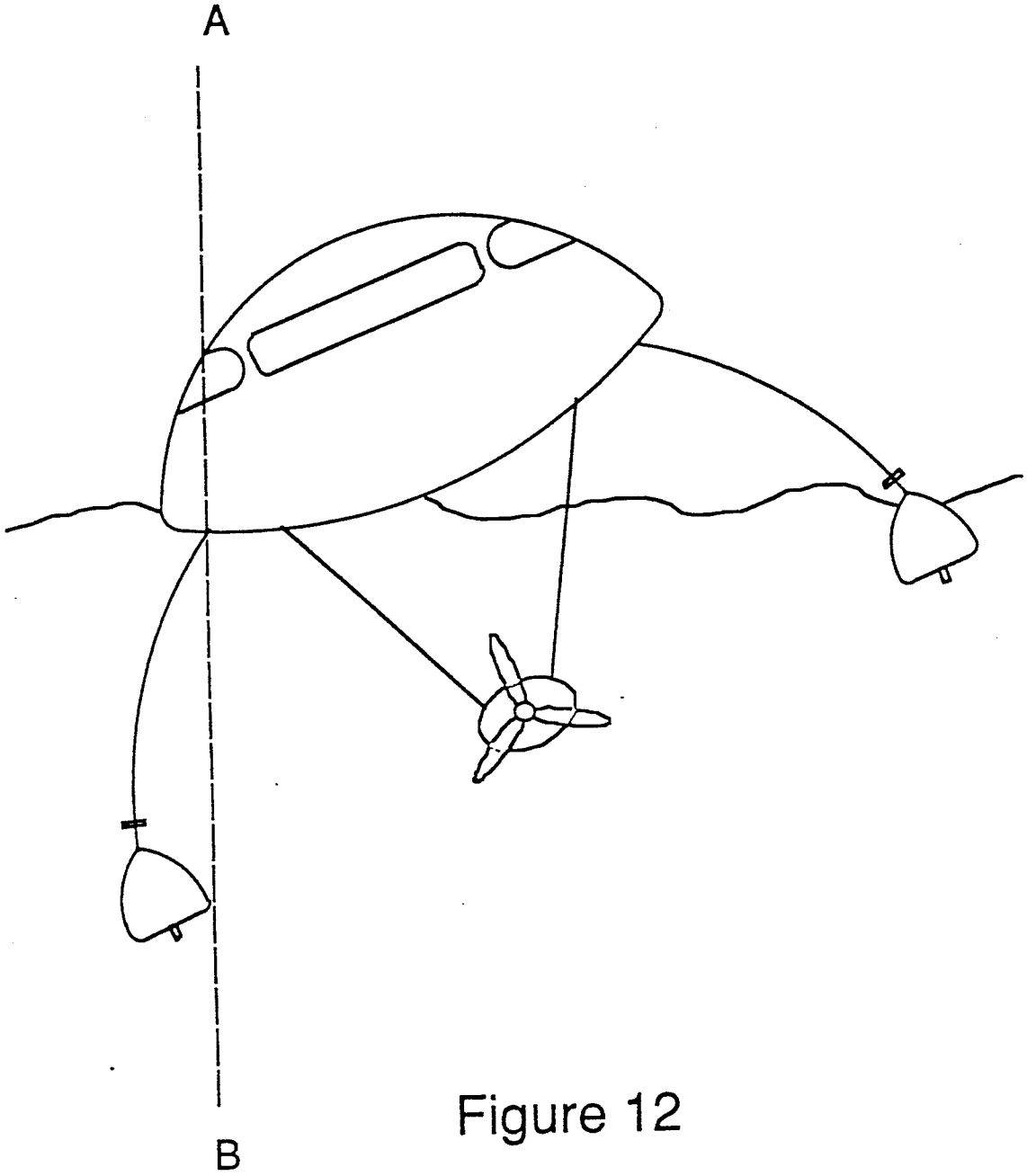
FIG. 12 shows the fuel-efficient watercraft in a default stable condition.

As discussed above, the controls of watercraft of the present invention must be used in a coordinated fashion. If mistakes in handling the craft are made, and a rolling motion initiated, a stable default position will result. Even if by improper operation one submarine hull should make it to the surface, in this configuration the other hull still would be on the opposite side of the craft's center of gravity since the separation of the hulls is chosen to guarantee this. Therefore, the submerged submarine hull cannot follow the other one to the surface. Rather, it is pushed deeper down since it now has to support more than its share of the weight of the cabin. This continues until the edge of the cabin touches the water and provides the needed additional buoyancy. FIG. 12 shows this position. Segment AB depicted therein represents the condition for this attitude to be stable. Provided that the buoyancy of the engine pod is negative or neutral, the condition for stability is that the submerged submarine hull has to be on the outboard side of segment AB. The design criteria should therefore see to it that this condition is fulfilled. The higher the craft's center of gravity, the farther apart the hulls must be. If the separation between the two submarine hulls is only one cabin width, the stability condition would not be fulfilled. Therefore, it is here specified that the separation should be more than one, but preferably two cabin widths.

Figure 13:
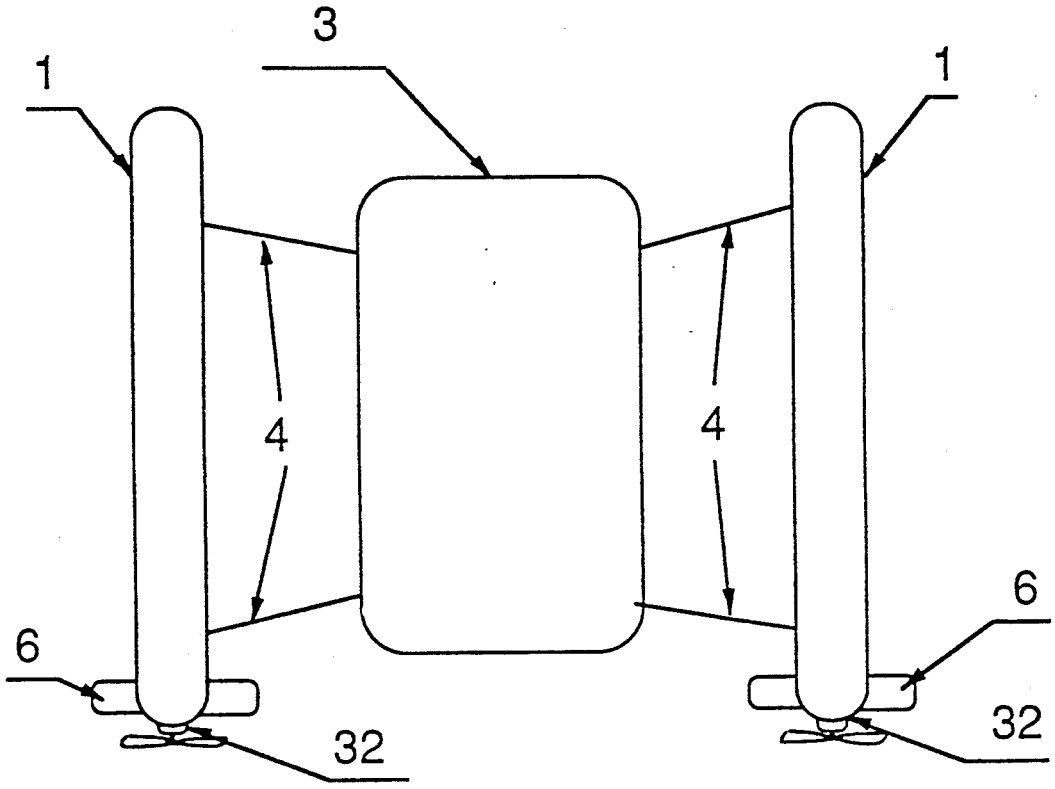
FIG. 13 is a top view of an alternate embodiment of the fuel-efficient watercraft, employing twin engine installation.
Figure 14:
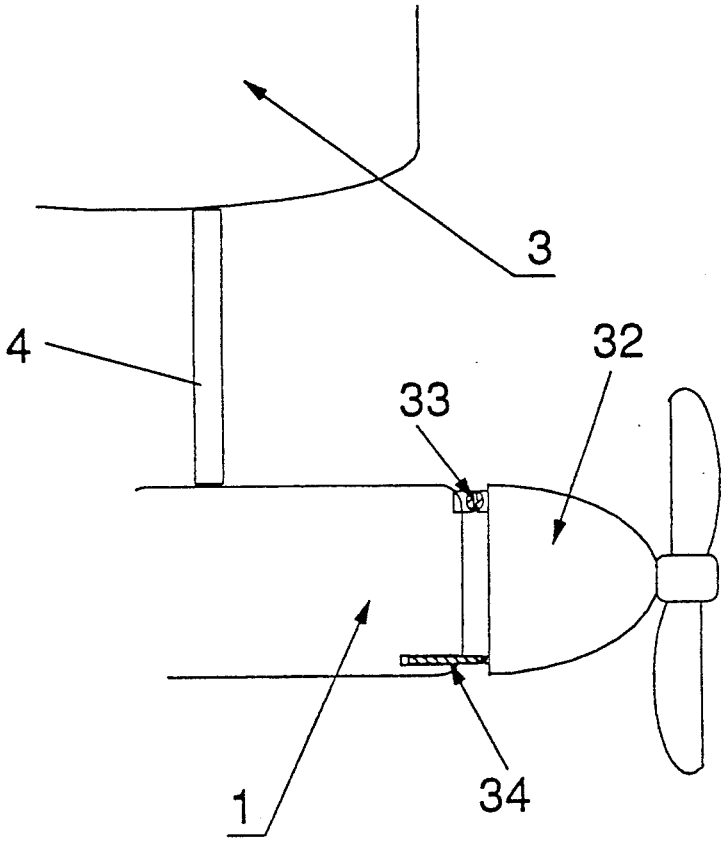
FIG. 14 is a side view of hull of the embodiment depicted in FIG. 13 which shows the engine connected at the stern end of the hull.

FIG. 13 shows a different embodiment of the present invention. Here an engine pod is not used. Instead, an engine (32) is installed in each hull (1). The advantage of this embodiment is that both steering and stability movements are facilitated; for example, by manipulating the rpm of the engines separately. This can be done either manually or automatically. The lack of an engine pod reduces drag considerably. FIG. 14 depicts a preferred embodiment of the hull-mounted engine. Engine (32) is pivotally connected to the stern end of hull (1) by engine mount (33) such that activation of the trim control rod (34) causes selective displacement of engine (32) in a vertical plane. As trim control rod (34) is moved inward into hull (1), the weight of engine (32) causes the engine to pivot downward about mount (33). As trim control rod (34) is moved outward from hull (1), it forces engine (32) to pivot upward about mount (33). In this fashion, selective activation of trim control rod (34) can also facilitate steering and stability movements.

It should be understood that the examples and embodiments described herein are for illustrative purposes only and that various modifications or changes in light thereof will be suggested to persons skilled in the art and are to be included within the spirit and purview of this application and the scope of the appended claims.

I claim:

1. A watercraft having improved performance capabilities comprising a cabin, having a top surface and a bottom surface;

a plurality of elongate hulls, having a bow end and a stern end and comprising a void space, each of said hulls further comprising a flow tube extending lengthwise through the hull and having a bow-end opening and a stern-end opening arranged such that water passes through said flow tube continuously while said watercraft is moving forward under normal operating conditions with each of said hulls submerged;

means for flooding said void space with water and for removing the water as desired;

a plurality of stanchions which connect said hulls to said cabin such that in normal operating mode the bottom surface of said cabin is operationally disposed above the surface of the water, and said hulls being sufficiently separated such that the watercraft's center of gravity remains positioned between the center of buoyancy of said hulls when one of said hulls is on the water's surface, another is submerged, and said cabin is in contact with the water's surface, said stanchions not contributing significantly to the buoyancy of the watercraft as a whole; and means for propulsion.

2. The watercraft of claim 1 wherein said means for propulsion comprises an engine pod swingably connected to the bottom of said cabin by at least one swing bar.

3. The watercraft of claim 2, wherein said hulls further comprise valve means disposed at each end of said flow tubes such that the bow-end opening and stern-end opening can be closed off, and means for removing water trapped therebetween.

4. The watercraft of claim 3, wherein each of said hulls further comprises a stabilization control surface.

5. The watercraft of claim 4, wherein each of said hulls further comprises an elongated trim tank having a bow end and a stern end, comprising a central dividing wall;

at least one air port disposed on each side of said central dividing wall, proximal to said wall, capable of allowing air into or out of the trim tank; a piston on each side of said central dividing wall disposed such that when air is forced through said air port into said tank, said piston is forced by the air away from said central dividing wall and toward the end of said tank; at least one water port disposed on each side of said central dividing wall, proximal to each end of said tank, capable of allowing water into or out of the trim tank; and valve means disposed in each end of said tank such that the inflow and outflow of water through said water port is controlled.

6. The watercraft of claim 5, further comprising a self-compensating fuel tank, which comprises a fuel bladder disposed inside a rigid enclosure, and a plurality of openings disposed in the rigid enclosure so as to permit water to flow through the openings and into said enclosure as the volume occupied by said fuel bladder decreases or out of said enclosure as the volume occupied by said fuel bladder increases, whereby the total volume of fluid inside the rigid enclosure can remain substantially constant.

7. The watercraft of claim 3, further comprising a streamlined storage box releasably mounted between said hulls.

8. The process of converting the watercraft of claim 3 into a raft, comprising the steps of positioning the valve means in each flow tube such that the flow tubes are open; and flooding the void space in each hull.

9. The process of parking the watercraft of claim 3 comprising the steps of maneuvering the watercraft into waters having a depth of from about one hull diameter to a depth which is less than the distance from the bottom of said hulls to the bottom of said cabin;

positioning the valve means in each flow tube such that the flow tubes are open; and flooding the void space in each hull.

10. The watercraft of claim 1 wherein said means for propulsion are disposed in each of said hulls.

11. The watercraft of claim 10, wherein said hulls further comprise valve means disposed at each end of said flow tubes such that the bow-end opening and stern-end opening can be closed off, and means for removing water trapped therebetween.

12. The watercraft of claim 11, wherein each of said hulls further comprises a stabilization control surface.

13. The watercraft of claim 12, wherein each of said hulls further comprises an elongated trim tank having a bow end and a stern end, comprising a central dividing wall;

at least one air port disposed on each side of said central dividing wall, proximal to said wall, capable of allowing air into or out of the trim tank;

a piston on each side of said central dividing wall disposed such that when air is forced through said air port into said tank, said piston is forced by the air away from said central dividing wall and toward the end of said tank;

at least one water port disposed on each side of said central dividing wall, proximal to each end of said tank, capable of allowing water into or out of the trim tank; and valve means disposed in each end of said tank such that the inflow and outflow of water through said water port is controlled.

14. The watercraft of claim 13, further comprising a self-compensating fuel tank, which comprises a fuel bladder disposed inside a rigid enclosure, and a plurality of openings disposed in the rigid enclosure so as to permit water to flow through the openings and into said enclosure as the volume occupied by said fuel bladder decreases or out of said enclosure as the volume occupied by said fuel bladder increases, whereby the total volume of fluid inside the rigid enclosure can remain substantially constant.

15. The watercraft of claim 11, further comprising a streamlined storage box releasably mounted between said hulls.

16. The process of converting the watercraft of claim 11 into a raft, comprising the steps of positioning the valve means in each flow tube such that the flow tubes are open; and flooding the void space in each hull.

17. The process of parking the watercraft of claim 11 comprising the steps of maneuvering the watercraft into waters having a depth of from about one hull diameter to a depth which is less than the distance from the bottom of said hulls to the bottom of said cabin;

positioning the valve means in each flow tube such that the flow tubes are open; and flooding the void space in each hull.

* * * * *